US010112631B2

(12) United States Patent
Lang et al.

(10) Patent No.: US 10,112,631 B2
(45) Date of Patent: Oct. 30, 2018

(54) RAIL VEHICLE

(71) Applicant: SIEMENS AKTIENGESELLSCHAFT, Munich (DE)

(72) Inventors: Stefan Sebastian Lang, Munich (DE); Hans Juergen Maerkl, Stadtbergen (DE)

(73) Assignee: Siemens Aktiengesellschaft, Munich (DE)

( * ) Notice: Subject to any disclaimer, the term of this patent is extended or adjusted under 35 U.S.C. 154(b) by 219 days.

(21) Appl. No.: 15/104,301

(22) PCT Filed: Dec. 4, 2014

(86) PCT No.: PCT/EP2014/076483
§ 371 (c)(1),
(2) Date: Jun. 14, 2016

(87) PCT Pub. No.: WO2015/090979
PCT Pub. Date: Jun. 25, 2015

(65) Prior Publication Data

US 2016/0311449 A1 Oct. 27, 2016

(30) Foreign Application Priority Data

Dec. 17, 2013 (DE) ..... 10 2013 226 177

(51) Int. Cl.
*B61F 5/52* (2006.01)
*B61F 5/50* (2006.01)
(Continued)

(52) U.S. Cl.
CPC ..... *B61F 5/52* (2013.01); *B61F 1/08* (2013.01); *B61F 5/50* (2013.01); *B61F 19/00* (2013.01)

(58) Field of Classification Search
CPC ..... E01H 8/00; E01H 8/02; E01H 8/04
See application file for complete search history.

(56) References Cited

U.S. PATENT DOCUMENTS 345,257 A * 6/1886 Priest ..... E01H 8/04 37/217
2,108,134 A * 2/1938 McNulty ..... B61F 19/06 37/207
(Continued)

FOREIGN PATENT DOCUMENTS

DE 69623661 T2 8/2003
DE 102010019272 A1 11/2011
(Continued)

*Primary Examiner* — Robert J McCarry, Jr.
(74) *Attorney, Agent, or Firm* — Laurence Greenberg; Werner Stemer; Ralph Locher

(57) ABSTRACT

A rail vehicle, in particular a locomotive, has at least one bogie with a bogie frame supported resiliently on sets of wheels, and a superstructure, which is supported resiliently on the at least one bogie and is mounted rotatably about a vertical axis, with a under frame. A removal device for removing snow and/or ice is arranged between the under frame and the bogie frame. The removal device has an inclined sliding surface which at least partially covers the bogie frame. Deposits of snow and/or ice both on the bogie frame and on the under frame of the superstructure can thereby be prevented or eliminated.

6 Claims, 3 Drawing Sheets

(51) Int. Cl.
*B61F 19/00* (2006.01)
*B61F 1/08* (2006.01)

(56) References Cited

U.S. PATENT DOCUMENTS

| | | | | |
|---|---|---|---|---|
| 4,274,212 | A * | 6/1981 | Kurkela | E01H 8/04 37/105 |
| 6,688,021 | B2 * | 2/2004 | Baig | E01H 8/10 104/279 |
| 2009/0021028 | A1 | 1/2009 | Hayashi | |
| 2012/0272858 | A1 | 11/2012 | Schmidt et al. | |

FOREIGN PATENT DOCUMENTS

| | | | |
|---|---|---|---|
| EP | 1930227 | A1 | 6/2008 |
| EP | 2017153 | A2 | 1/2009 |
| JP | 2006327452 | A | 12/2006 |
| JP | 2009184380 | A | 8/2009 |
| JP | 2010201984 | A | 9/2010 |
| RU | 7426 | U1 | 8/1998 |
| WO | 2011088996 | A1 | 7/2011 |

* cited by examiner

RAIL VEHICLE

BACKGROUND OF THE INVENTION

Field of the Invention

The invention relates to a rail vehicle, in particular a locomotive, comprising at least one bogie with a bogie frame supported resiliently on sets of wheels, a superstructure which is supported resiliently on the at least one bogie and is mounted rotatably about a vertical axis with a under frame and a removal device for removing snow and/or ice which is arranged between the under frame and the bogie frame, and which has an inclined sliding surface that at least partially covers the bogie frame.

When rail vehicles are operated in winter swirling snow accumulates on the surfaces of the bogie frames and on the underside of the superstructure. The masses of snow accumulating here are compacted by the rotary and compression movements between the bogie frame and the under frame of the superstructure and are turned into ice formations. The necessary freedom of movement of the bogie under the superstructure is restricted. Furthermore the accumulations of snow and ice places additional loads on the bogie frame. These can grow into a large clump, which at some point during the journey of the rail vehicle falls onto the track bed. In this situation there is the danger that a subsequent bogie of the rail vehicle travels over the icy clumps of snow, in which case components on the subsequent bogie may be damaged or even torn off completely.

To solve this problem it is known to clear the snow and ice off the bogie frames and the under frame of the superstructure regularly by hand, which is associated with considerable expenditure in terms of manpower and time, and hence with high maintenance costs.

The use of de-icing systems for rail vehicles is also known, but these involve high acquisition and operating costs. Alternatively it is known to spray the bogie separately with de-icing agents. However, the difficulty with using de-icing agents is that they only adhere to the bogie for fifteen minutes, for example, and thereafter lose their effectiveness.

Another known proposed solution for preventing an accumulation of snow and ice on the bogie is to provide the bogie frame with a coating of paint. Several paint coatings have already been tested, but as yet no paints are known which can stop snow from accumulating in the long run.

Another proposed solution involves heating the bogie frame, which however results in an undesirable increase in energy consumption.

On the other hand unexamined German application DE 10 2010 019 272 A1 discloses a bogie truck for a rail vehicle, the bogie frame of which is formed from hollow profiles, wherein the bogie frame is filled at least partially with a latent storage material, the phase change temperature of which is above 0° C. If during the day a bogie heats up to a temperature of for example 15° C., the latent storage material retains this temperature at least partially despite a drop in the ambient temperature at night. This means any accumulation of snow or ice is prevented in these bogie regions. However, there is a danger that the resultant meltwater will run into other bogie regions, where it will freeze again and impair the functioning of other components.

Known from the translation DE 696 23 661 T2 of European patent publication EP 0 932 540 B1 is a device for preventing the buildup of snow or ice on an external surface of a structural member of a railbound vehicle. The structural member may for example be in the form of a box girder for a bogie, the plane outer surface of which and the side surfaces of which are coated with snow- and ice-repelling outer and inner layers. The outer layer has an even, stiff and smooth surface and is inclined toward the horizontal plane such that the top of the plane surface forms a roof-like geometry. The inner layer consists of a material with a high heat-insulating capacity and a high elasticity.

BRIEF SUMMARY OF THE INVENTION

The object of the invention is hence to take measures which prevent or eliminate the accumulation of masses of snow and ice both on the bogie frame and on the underside of the superstructure.

The object is inventively achieved by a rail vehicle of the type mentioned in the introduction with the features as claimed. The rail vehicle, for example a locomotive, comprises at least one bogie with a bogie frame supported resiliently on sets of wheels. Resiliently supported on the at least one bogie is a superstructure with a under frame mounted rotatably about a vertical axis. Arranged between the under frame and the bogie frame is a removal device for removing snow and/or ice, which has an inclined sliding surface which at least partially covers the bogie frame. Pieces of snow or ice falling from above can no longer accumulate on the covered, plane top sides of the bogie frame, since they hit the inclined sliding surface, slide down it, and thus are removed from the bogie frame. The removal device is formed by a simple mechanical component which covers at least the critical accumulation regions of the bogie, for example the main cross-member of the bogie frame. The sliding surface can be formed, somewhat in the manner of a single-pitch roof, by a single overall surface or by several partial surfaces inclined in the same direction. The removal device has an upwardly directed breaker edge which is rigidly connected to the bogie frame such that an accumulation of snow and/or ice can be broken up when penetrated by the breaker edge because of relative movements between bogie frame and under frame. When the bogie compresses and pitches a vertical relative movement takes place between bogie frame and under frame of the superstructure. This relative movement is utilized by the invention: the breaker edge of the removal device, for example the top edge of the sliding surface or the top edges of the partial surfaces thereof, is attached to the bogie frame and spaced apart there from such that although during the relative movement it does not collide with the under frame it comes so close to it that it penetrates an accumulation of snow and/or ice above a particular size and breaks it up into pieces of snow and/or ice. These fall down and when they hit the sliding surface they are removed along it.

In an advantageous embodiment of the inventive rail vehicle the sliding surface has two opposingly inclined partial surfaces which run up to one another to form a peak. This embodiment in the manner of a gabled roof prevents snow and/or ice from accumulating underneath the sliding surface, since the one partial surface is isolated from the other partial surface in each case. The peak angle enclosed by the partial surfaces is preferably an acute angle, for example in the region of 80°.

In an advantageous embodiment of the inventive rail vehicle the removal device has an attachment interface for attachment means, by means of which the removal device can be attached to bogie frames of different widths. Because of this it is possible to equip rail vehicles for the first time and to retrofit them according to the season for different bogie widths using the same removal devices.

In a preferred embodiment of the inventive rail vehicle the removal device is designed as an integrally formed sheet metal part which has a rounded breaker edge and two gable-roof-type partial surfaces emerging from the breaker edge as a sliding surface, wherein the attachment interface is formed by coplanar contact surfaces with elongated holes abutting the partial surfaces. The integral profiled formed sheet metal part is easy to manufacture and thanks to the bending edges has a high structural integrity. The integral nature simplifies the mounting and dismounting of an inventive removal device. Thanks to the elongated holes in the contact surfaces there is a flexible attachment interface for attachment means at differently positioned attachment points on the bogie frame.

BRIEF DESCRIPTION OF THE SEVERAL VIEWS OF THE DRAWING

Further properties and advantages of the invention will emerge from the following description of an exemplary embodiment with the aid of the drawings, in which schematically

DESCRIPTION OF THE INVENTION

Figure 1:
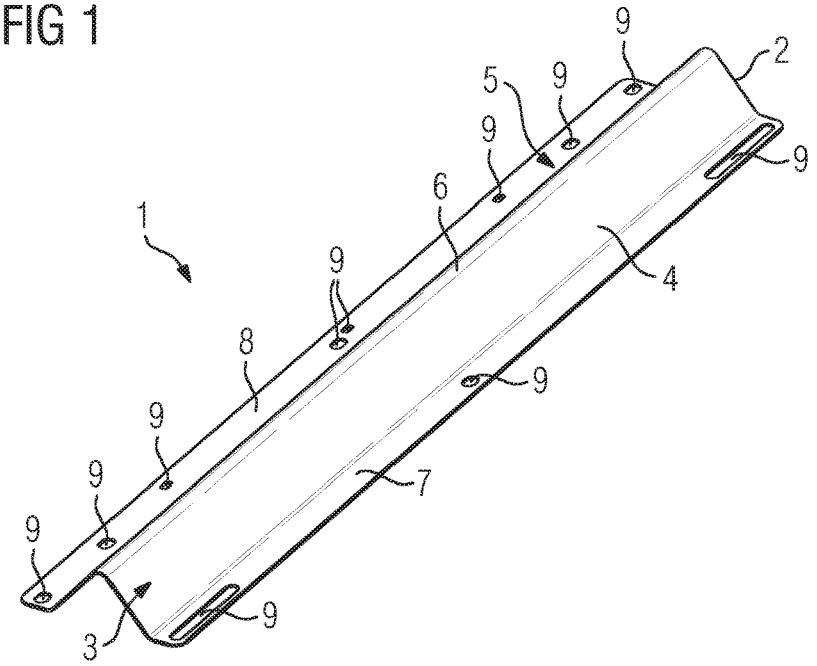
FIG. 1 shows a perspective view of an inventive removal device.
Figure 2:
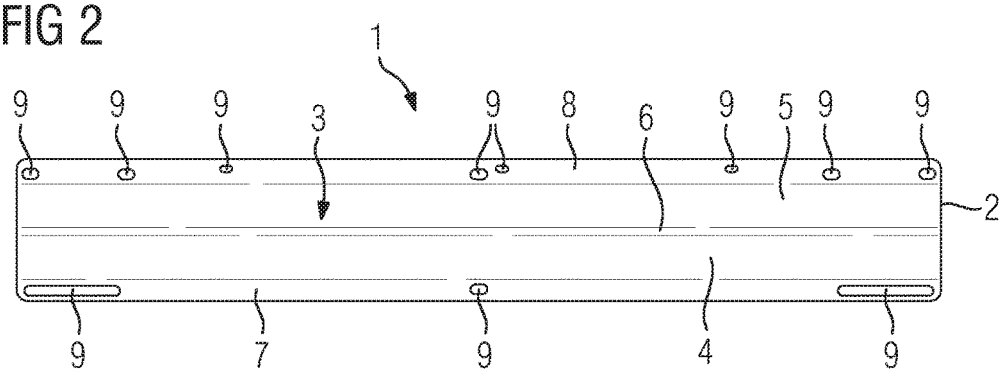
FIG. 2 shows a plan view of the removal device according to FIG. 1.
Figure 3:
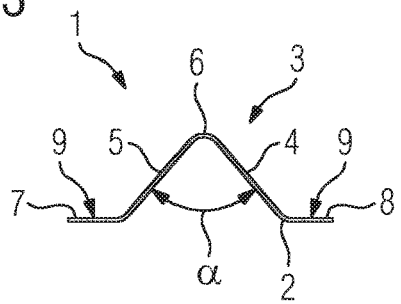
FIG. 3 shows a side view of the removal device according to FIG. 1.
Figure 4:
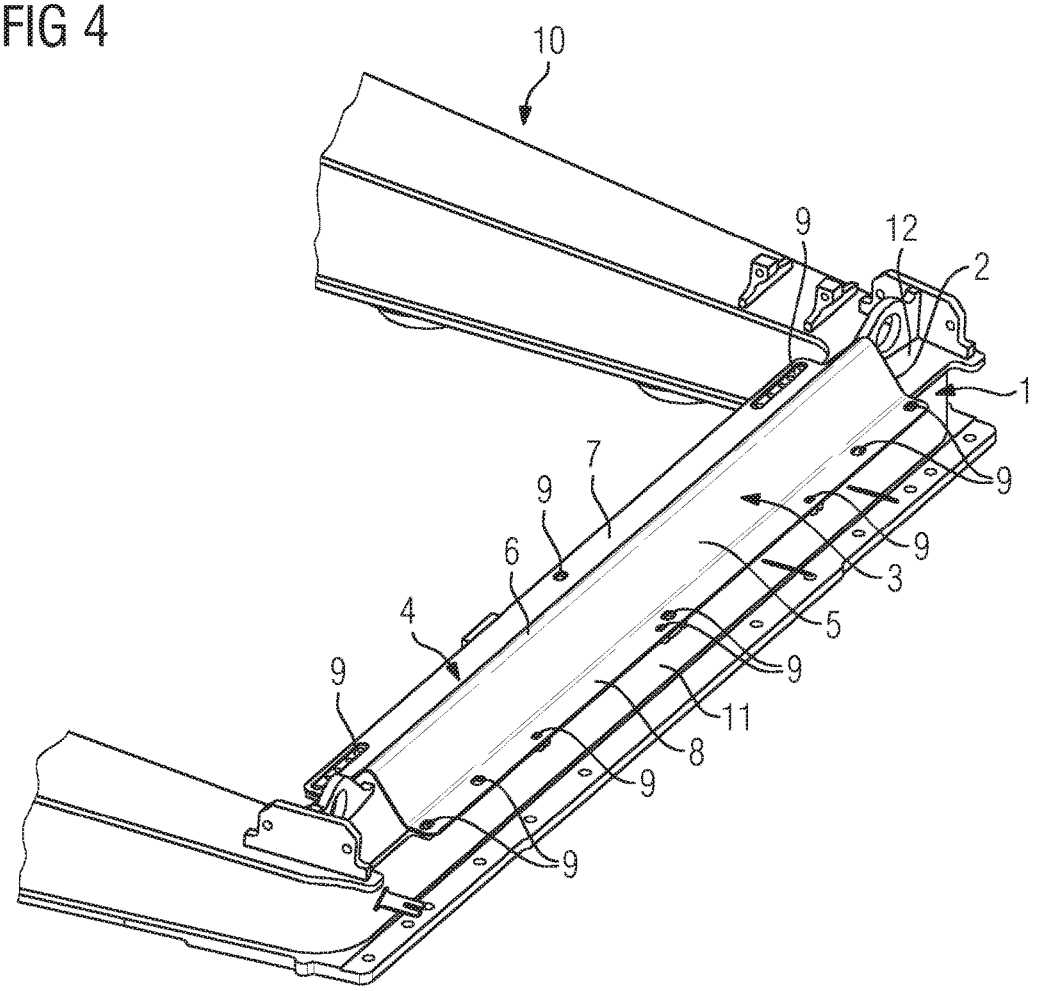
FIG. 4 shows a perspective view of the removal device according to FIG. 1 attached to a bogie frame.
Figure 5:
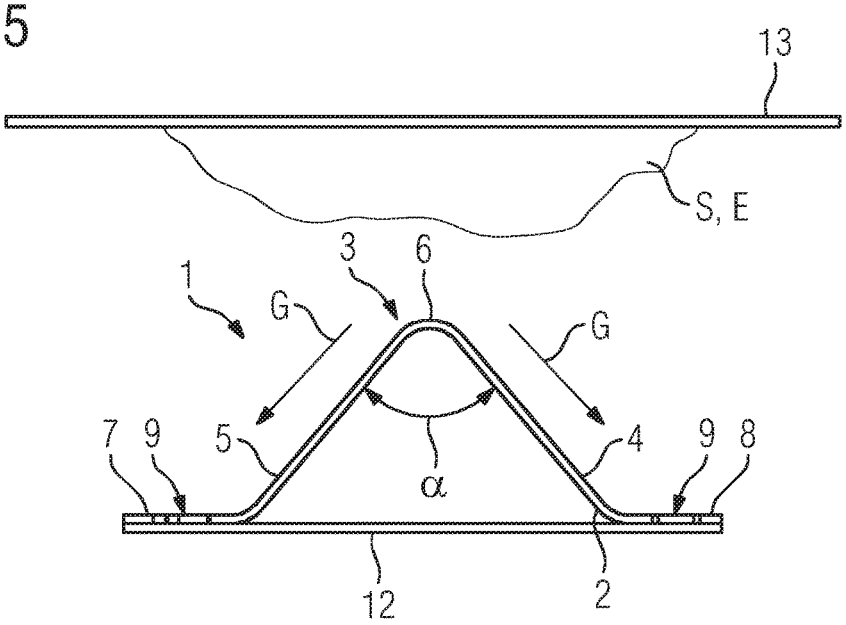
FIG. 5 shows a side view of the removal device according to FIG. 1 arranged between a under frame and a bogie frame and FIG. 6 shows a side view of the removal device according to FIG. 5 when the bogie is compressed.
Figure 6:
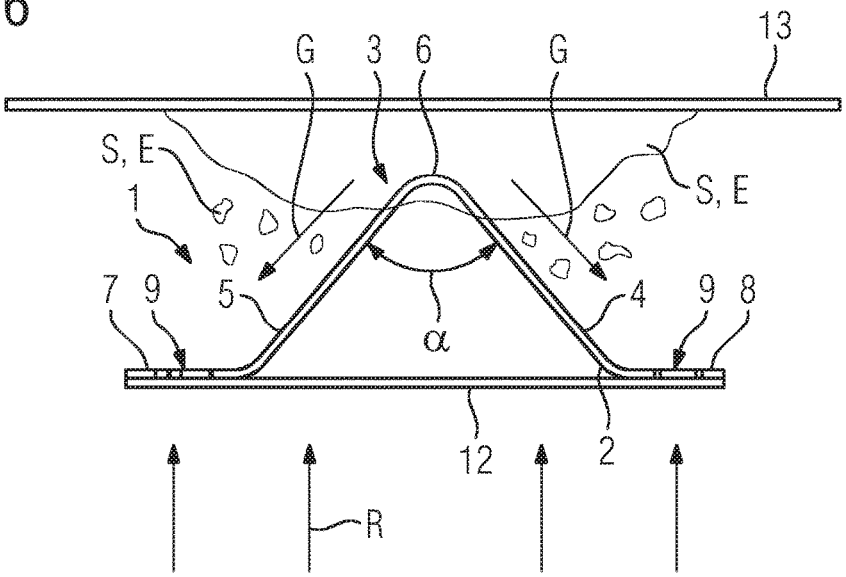

A removal device 1 according to FIG. 1 to FIG. 3 for removing snow S and/or ice E according to FIG. 5 and FIG. 6 is arranged between a under frame 13 of a superstructure of a rail vehicle and a bogie frame 10 of a bogie of the rail vehicle. According to FIG. 4 the removal device 1 has an inclined sliding surface 3 which at least partially covers the bogie frame 10. For stability reasons and because of the ease of manufacture the removal device 1 is bent from a sheet metal part 2. The integral bent sheet metal part 2 has a two-part sliding surface 3 in the manner of a gable roof, wherein the first partial surface 4 is inclined in an opposing manner to a second partial surface 5. The partial surfaces 4 and 5 run up to one another to form a peak and are connected to one another by way of an upward pointing, rounded breaker edge 6. The two partial surfaces 4 and 5 form a peak angle $\alpha$, which is preferably acute and for example can be about 50°. The partial surfaces 4 and 5 each merge downward into an angled first and second contact surface 7 and 8, each of which is oriented in a coplanar manner to the other. The contact surfaces 7 and 8 serve to connect the removal device 1 to the bogie frame 10. To this end the contact surfaces 7 and 8 have elongated holes 9, through which attachment means (not shown), for example screws, can pass. The length and positioning of the elongated holes 9 are designed such that the same removal device 1 can be mounted on different widths of bogie. The removal device 1 is a component independent of the bogie frame 10 and can be mounted onto or dismounted from the bogie at any time thanks to its attachment interface. The removal device 1 can thus firstly be retrofitted on existing rail vehicles and secondly if need be can be fitted in the winter months and removed again in the summer months. The elongated bore holes 9 for screw-fitting to the cantrail 12 are moreover arranged such that a single embodiment of the removal device 1 can be utilized for different bogie frames 10. Thus one variant can for example be utilized both on broad-gauge and on normal-gauge bogie. Additionally the advantage of the variable screwed connection is that in the event of damage the removal device 1 can be replaced at no great expense.

According to FIG. 4 the removal device 1 is mounted on the cantrail 12 of a head cross-member 11 of the bogie frame 10 and covers the major part of its top side. The removal device 1 extends in the exemplary embodiment illustrated crossways to a longitudinal bogie axis. The plane surface of the cantrail 12, which would favor an accumulation of snow S and/or ice E, is covered according to FIG. 5 by the sloping sliding surface 3. The partial surfaces 4 and 5 mean the snow S slips down in a sliding movement G and falls off the bogie frame 10. If the bogie is compressed and/or pitched according to FIG. 5 and the result is a relative movement R between bogie frame 10 and under frame 13, then the removal device 1 participates in this and with its breaker edge 6 strikes the accumulation of snow S and/or ice E on the under frame 13 of the superstructure of the rail vehicle. As a result the ice E is broken up and is detached from the under frame 13. This means the removal device 1 prevents accumulations of snow S and/or ice E both on the bogie frame 10 and also on the under frame 13 of the superstructure.

The invention claimed is:

1. A rail vehicle, comprising:

at least one bogie with a bogie frame supported resiliently on sets of wheels;

a superstructure resiliently supported on said at least one bogie and mounted rotatably about a vertical axis, said superstructure having an under frame;

a removal device for removing snow and/or ice, said removal device being arranged between said under frame and said bogie frame;

said removal device having an inclined sliding surface disposed to at least partially cover said bogie frame;

said removal device having an upwardly oriented breaker edge rigidly connected to said bogie frame and facing toward said under frame, said breaker edge causing an accumulation of snow and/or ice on said under frame to be broken up upon being penetrated by said breaker edge when said bogie frame together with said breaker edge move relative to said under frame.

2. The rail vehicle according to claim 1, being a locomotive.

3. The rail vehicle according to claim 1, wherein said sliding surface has two oppositely inclined partial surfaces running up to one another to form a peak.

4. The rail vehicle according to claim 3, wherein said removal device has an attachment interface for attachment means enabling said removal device to be attached to different widths of bogie frame.

5. The rail vehicle according to claim 4, wherein said removal device is an integrally formed one-piece sheet metal part formed with a rounded breaker edge and two gable-roof-shaped partial surfaces emerging from said breaker edge as a sliding surface, and wherein said attachment interface is formed by coplanar contact surfaces having elongated holes abutting said partial surfaces.

6. The rail vehicle according to claim 1, wherein said removal device has an attachment interface for attachment means enabling said removal device to be attached to different widths of bogie frame.

* * * * *